US010173333B2

(12) United States Patent
Bowness

(10) Patent No.: US 10,173,333 B2
(45) **Date of Patent: *Jan. 8, 2019**

(54) RAZOR SHARPENING DEVICE

(71) Applicant: David Bowness, Quincy, MA (US)

(72) Inventor: David Bowness, Quincy, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/794,354

(22) Filed: Oct. 26, 2017

(65) Prior Publication Data

US 2018/0126573 A1 May 10, 2018

Related U.S. Application Data

(63) Continuation of application No. 15/344,847, filed on Nov. 7, 2016, now Pat. No. 9,827,685.

(51) Int. Cl.

| | |
|---|---|
| ***B26B 21/50*** | (2006.01) |
| ***B24B 1/00*** | (2006.01) |
| ***B26B 21/56*** | (2006.01) |
| ***B24D 15/08*** | (2006.01) |

(52) U.S. Cl.
CPC ..... *B26B 21/56* (2013.01); *B24D 15/08* (2013.01)

(58) Field of Classification Search
CPC ..... B24D 15/10; Y10S 76/09
USPC ..... 30/34.05, 35, 538, 527; 76/81.6, 81, 76/81.5, 82; 451/566, 54, 45, 162, 164, 451/241, 524, 556
See application file for complete search history.

(56) References Cited

U.S. PATENT DOCUMENTS

| | | | | |
|---|---|---|---|---|
| 1,905,330 | A * | 4/1933 | Aronson | B26B 21/50 30/36 |
| 2,348,303 | A | 5/1944 | Muros | |
| 2,391,741 | A | 12/1945 | Rhegas | |
| 2,397,644 | A | 4/1946 | Brooke | |
| 2,505,493 | A * | 4/1950 | Herrmann | B26B 21/22 30/50 |
| 2,643,452 | A | 6/1953 | Fennelly | |
| 5,546,660 | A | 8/1996 | Burout et al. | |
| 6,009,624 | A | 1/2000 | Apprille, Jr. et al. | |
| 6,161,288 | A | 12/2000 | Andrews | |
| 6,418,623 | B1 | 7/2002 | Marcarelli | |
| 6,493,950 | B1 | 12/2002 | Kludjian et al. | |
| 6,772,523 | B1 | 8/2004 | Richard et al. | |
| 8,671,576 | B1 | 3/2014 | Hotella | |

FOREIGN PATENT DOCUMENTS

| | | |
|---|---|---|
| WO | 2010006422 | 1/2010 |
| WO | 2014039264 | 3/2014 |

* cited by examiner

*Primary Examiner* — Ghassem Alie
(74) *Attorney, Agent, or Firm* — Lambert Shortell & Connaughton; Gary E. Lambert; David J. Connaughton, Jr.

(57) ABSTRACT

A cartridge razor sharpening device is provided. The sharpening device is configured to sharpen blades of cartridge razors, allowing for extended life and use. The device may operate to either slide over the blades to sharpen the blade edge, or may allow the blades to slidably move on the cartridge over the sharpening device. In some embodiments, a blade adjustment mechanism may be utilized to adjust a position of the blades after sharpening.

14 Claims, 5 Drawing Sheets

RAZOR SHARPENING DEVICE

BACKGROUND OF THE INVENTION

Field of the Invention

The present invention relates generally to sharpening devices. More particularly the present invention relates to a device to sharpen razor blades, specifically razor blade cartridges.

Description of Related Art

Razor blades are common implements used to remove hair very closely to the skin. While many types and styles of razors exist, a very common type is the cartridge razor. Cartridge razors such as those sold by, for example, Gillette®, are ubiquitous in the industry and are used by both men and women.

However, a common shortcoming of cartridge razors is that they rapidly dull, and must be replaced frequently at a relatively high cost. Were these cartridge razors able to be sharpened, their operational life could be greatly extended.

Therefore, what is needed is a device that may efficiently and easily sharpen the blade or blades of a cartridge razor.

SUMMARY OF THE INVENTION

The subject matter of this application may involve, in some cases, interrelated products, alternative solutions to a particular problem, and/or a plurality of different uses of a single system or article.

In one aspect, a razor blade sharpening device for cartridge razors is provided. This invention allows cartridge style razor blades to be sharpened instead of being disposed of. The sharpening device of this aspect has a body configured and sized to be positioned over a part of a front portion of the cartridge razor. A sharpening face of the body is sized and configured to receive a razor blade face and, when slid along the blade, configured to sharpen the blade. The sharpening face may be recessed into the body, may protrude from the body, or may be of any other structure capable of sharpening the blades. In this aspect, the sharpening device is slideable along the cartridge base length which also defines the length of the blades. Upon a sliding motion, either singular or repeated, the blades may be sharpened by the sharpening device, allowing for extended life and more efficient use of the cartridge razor.

In another aspect, a sharpenable razor blade cartridge is provided. The cartridge has a base with a plurality of razor blades attached thereto, and a connection portion allowing connection to a razor handle. A sharpening device is also attached to the base. The sharpening device has a body positioned over a part of a front portion of the cartridge razor in communication with the plurality of blades. A plurality of sharpening faces are formed by the body, with each of the plurality of sharpening faces interfacing with one of the razor blades. The sharpening faces are configured to sharpen the razor blades when drawn across the blade edges.

In yet another aspect, a sharpenable razor blade cartridge is provided. The cartridge has a base with a plurality of razor blades attached thereto, and a connection portion allowing connection to a razor handle. In this aspect, the razor blades are laterally movable from a resting position to a sharpening position outward from the base. A sharpening device is attached to the base at one lengthwise side of the base. This sharpening device is configured to sharpen the plurality of blades as they are moved between the resting position and sharpening position. The sharpening device is formed of a body and a plurality of sharpening faces formed by the body. Each one of the plurality of sharpening faces interfaces with one of the plurality of razor blades of the cartridge. The sharpening faces are configured to sharpen the blade as the sharpening face is passed over a blade edge when the blades are moved between the resting position and sharpening position.

DETAILED DESCRIPTION

The detailed description set forth below in connection with the appended drawings is intended as a description of presently preferred embodiments of the invention and does not represent the only forms in which the present invention may be constructed and/or utilized. The description sets forth the functions and the sequence of steps for constructing and operating the invention in connection with the illustrated embodiments.

Generally, the present invention concerns a sharpening device for cartridge razors. This device is formed having sharpening grooves that fit into the razor and engage with the blade or blades. The sharpening grooves, when passed over the blade, serve to sharpen the blade. In varying embodiments, the sharpening system may be attachable to existing razor cartridges, may be removable, may be installed into the razor cartridges during manufacture, and the like. In some embodiments, the sharpening structure may be removably attachable to the razor cartridges with the razor cartridges may be specifically designed to receive the removable sharpening structure.

This sharpening may be done by honing to re-align the blade edge, by sharpening to re-set the blade edge, or any other method that provides a sharp and clean razor blade edge. Further, in varying embodiments honing may include contact with a top, bottom, or both surfaces of the blade. The term sharpening is used herein to refer to any of these types of blade treatment that may increase their effectiveness in cutting hair.

Typically, the sharpener of the present invention may be slideable with respect to the blades. This sliding may be achieved by a sharpener moving across the blades, or a slideable razor assembly that is drawn across the sharpener.

In one embodiment, the razor cartridge may further comprise a blade adjustment mechanism. This mechanism may re-align or move the blades after sharpening. For example, if the sharpening device forms a new blade edge by removing metal from the razor, the width of the razor decreases, and it's relation to other razors on the cartridge changes. The adjustment mechanism may urge these razors back to their original position. In a particular embodiment, a cam-shaped rod may be rotatably positioned on the cartridge and in either direct or indirect physical contact with a blade or blades of the cartridge. The cam-shaped rod, when rotated, urges the blade or blades downward by virtue of its increasing width. This blade adjustment mechanism may include a particular gradation or step amount to allow controlled, incremental movement after each sharpening or after a predetermined number of sharpenings.

Figure 1:
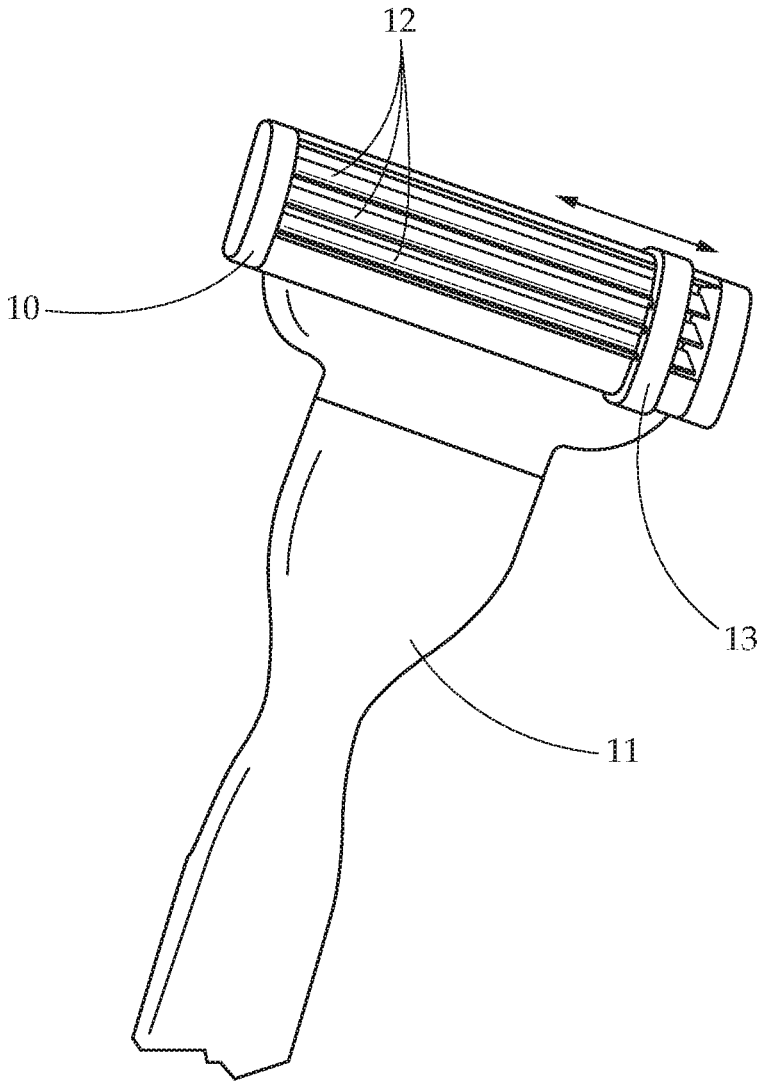
FIG. 1 provides a perspective view of an embodiment of the present invention.

Turning now to FIG. 1, a perspective view of an embodiment of the present invention is provided. In this view, a razor includes a handle 11 and a cartridge 10 attached to the handle. On the cartridge 10 base are three blades 12 (of course, the number of blades 12 may vary without straying from the scope of this invention). A sharpener 13 is slideably attached to the cartridge 10 base and slideable along the length of blades 12 in the directions indicated by the arrows. The sharpener 13 includes three sharpening surfaces, one surface in contact with each blade 12. As the sharpener 13 is drawn laterally across the blades 12, the sharpening surface sharpens the blade 12.

The sharpener 13 may be formed of any number of materials. Typically, in the sharpening surfaces a hardened material may be employed, either as an insert, or the entire sharpener 13 may be made of this material. Sharpening surface materials may include hard metals such as steel, as well as ceramics, among other options.

In one embodiment, the sharpener 13 may be movable to a side of the cartridge and may be recessed therein such that its outer surface does not protrude substantially beyond the outer end of the blade 12 edge. This movement, as well as the lengthwise movement may be guided by a track (not shown) on the cartridge 10. This structure may allow the blade 12 to sit flushly against a user's skin without interference by the sharpener 13. Similarly, the sharpener 13 may be removable from the cartridge 10 so that it does not interfere with blade operation. In one removable embodiment, the sharpener 13 may be formed at least partially of a flexible material and may clip on over the top and bottom of the cartridge.

Figure 2:
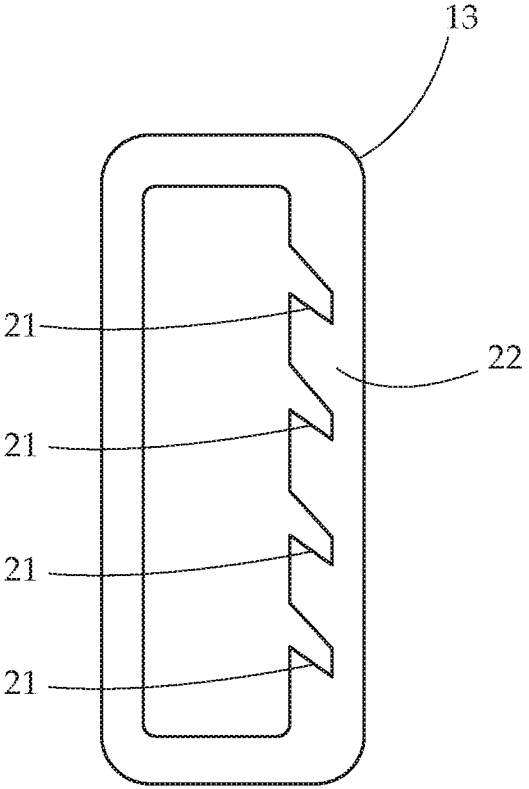
FIG. 2 provides a side view of an embodiment of a sharpener of the present invention.

FIG. 2 shows another embodiment of the sharpener of the present invention. In this view, a side of the sharpener 13 is shown. Sharpener 13 is configured to surround the cartridge over the blades. In this embodiment, sharpener 13 may slide over blades, or the blades may be movable over the sharpener 13. The sharpener 13 has a front face 22 which defines four sharpening surfaces 21 (this sharpener is for use on a four bladed razor cartridge). The sharpening surfaces 21 may have at least a portion that is formed of a hard material, for example a hard metal or ceramic. While not necessarily shown to scale, the sharpening surfaces 21 function to sharpen the blades of the razor cartridge to which they are in communication with.

Figure 3:
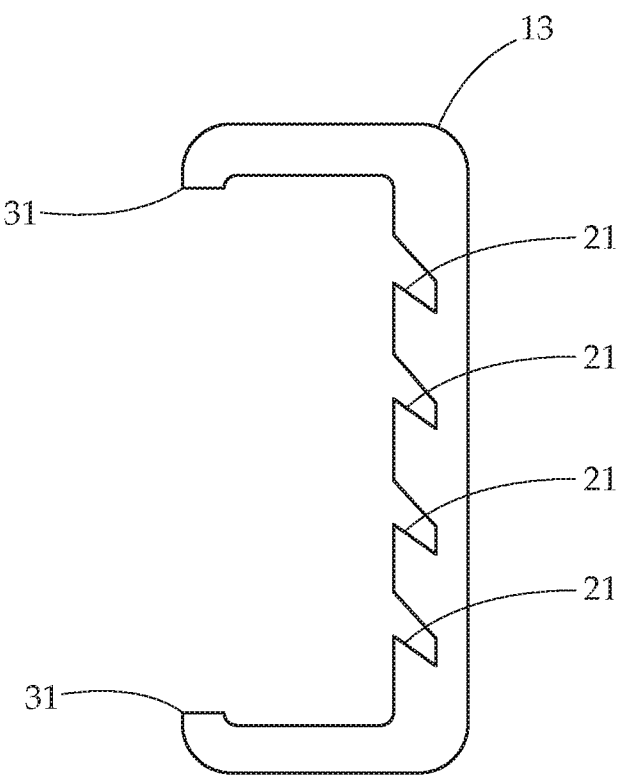
FIG. 3 provides a side view of an embodiment of a sharpener of the present invention.

FIG. 3 provides a side view of another embodiment of the sharpener of the present invention. In this view, a side of the sharpener 13 is shown. In this embodiment, sharpener 13 may slide over blades, or the blades may be movable over the sharpener 13. The sharpener 13 has a front face 22 which defines four sharpening surfaces 21 (this sharpener is for use on a four bladed razor cartridge). The sharpening surfaces 21 may have at least a portion that is formed of a hard material, for example a hard metal or ceramic. While not necessarily shown to scale, the sharpening surfaces 21 function to sharpen the blades of the razor cartridge to which they are in communication with. The sharpener 13 is configured to be positioned on the cartridge, either permanently or removably. Arms 31 extend from the front face of the sharpener with a slight downward protrusion. This protrusion holds the sharpener 13 in place on the cartridge and allows it to slide along the blades and cartridge.

Figure 4:
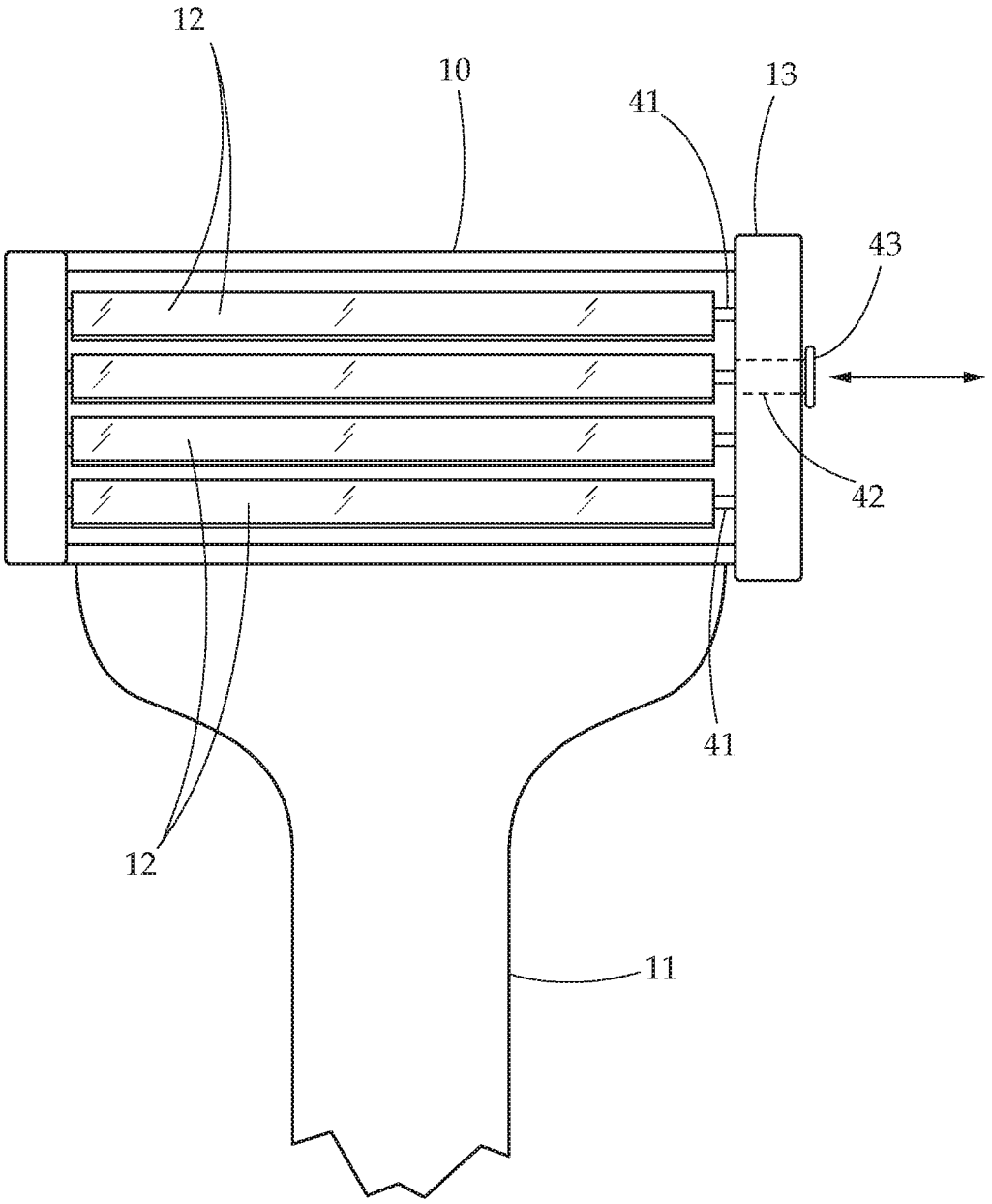
FIG. 4 provides a front view of another embodiment of the present invention.

FIG. 4 provides a front view of another embodiment of the present invention. In this view, sharpener 13 is fixed on a side of cartridge 10, and the blades 12 are slideable laterally across the sharpener 13. Cartridge 10 has four blades 12. These blades are movable along rods 41 between a resting position for razor use, and a sharpening position at least partially outside of the cartridge 10. A handle 43 extends from a side of the cartridge 10. This handle 43 may be drawn or pushed laterally (as indicated by arrows). A shaft 42 connects to the blades 12 so that as the handle 43 is laterally drawn, the blades 12 are drawn as well to move between the resting position and the sharpening position. When the handle 43 and blades 12 are drawn outwards, they are passed over the sharpening surfaces (not shown) of the sharpener 13, thereby sharpening the blades. This embodiment may further employ a locking structure or system to hold the blades in place when not being sharpened. For example, a ridge on handle 43, a twist locking structure, and the like may be employed.

Figure 5:
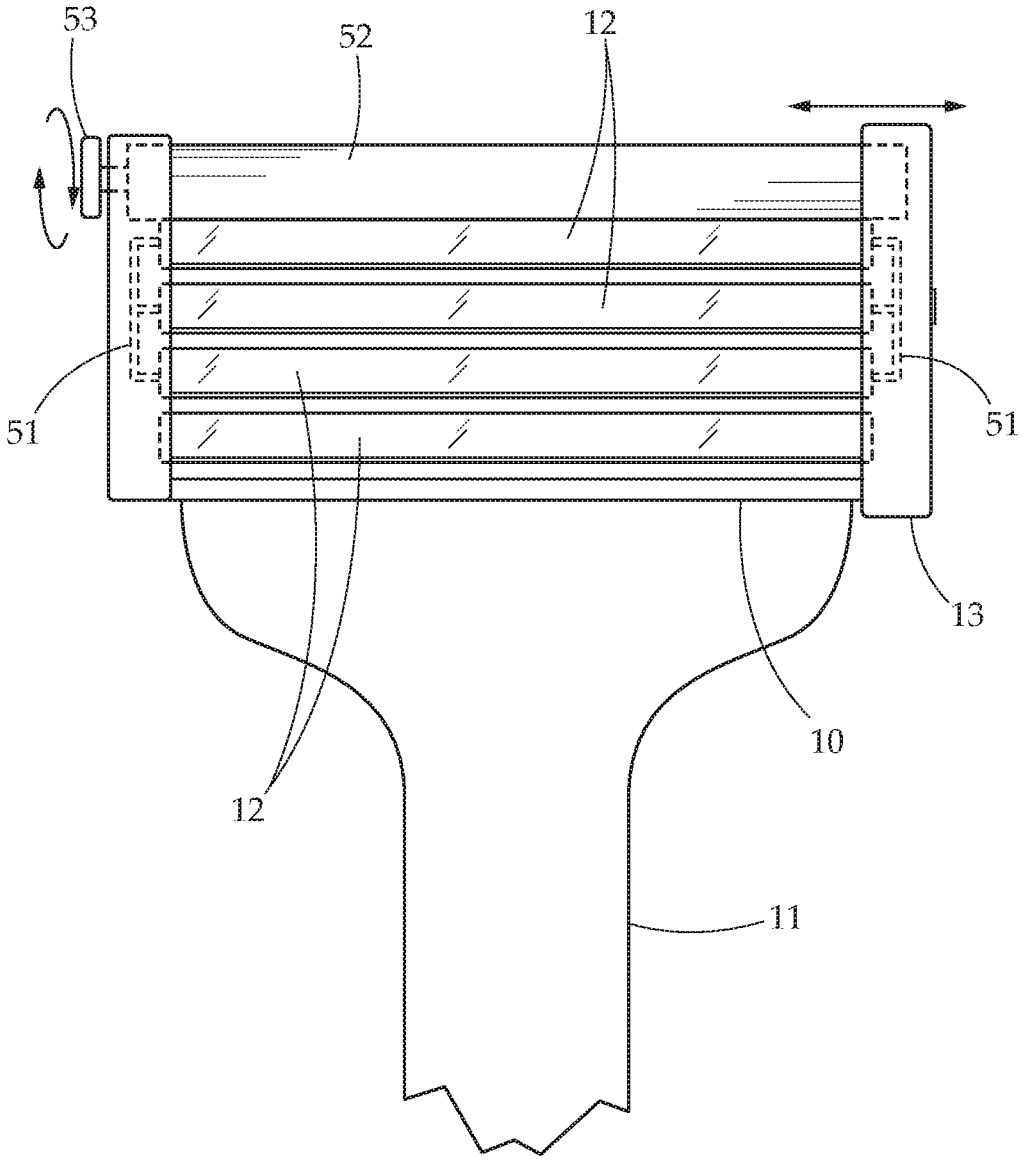
FIG. 5 provides a front view of yet another embodiment of the present invention.
Figure 6:
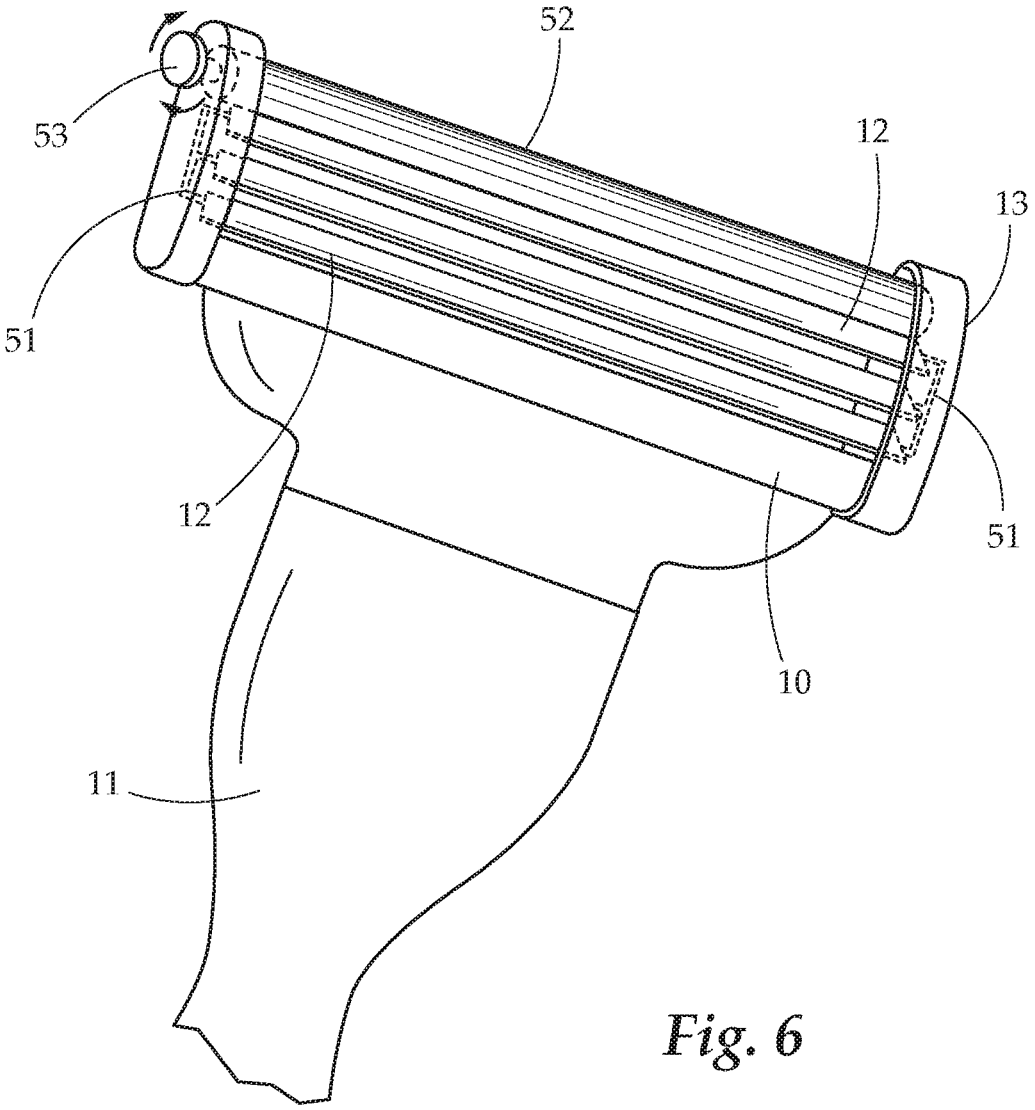
FIG. 6 provides a perspective view of still embodiment of the present invention.

FIGS. 5 and 6 provide a front and perspective view of an embodiment of the present invention. Cartridge 10 is attached to handle 11, and contains four blades 12. In this view, sharpener 13 is slideable laterally along the length of the blades 12 as shown by arrows, to sharpen the blades 12. The sharpener 13 in this embodiment may be configured to create a new blade edge by removing some portion of the existing blade edge in order to sharpen the blades 12. Further, the cartridge 10 has a blade adjustment mechanism which operates to adjust a position of the blades 12 to accommodate for change in size or orientation caused by sharpening.

While various blade adjustment structures may be employed without straying from the scope of this invention, the embodiment shown operates using rotation of a cam-shaped shaft 52. The cam-shaped shaft 52 has an approximately oval shape in this embodiment with a thickness that various over its height. The cam-shaped shaft 52 contacts a top blade 12 and, when rotated, urges the top blade 12 downward. In this embodiment, blades 12 are connected to each other by connectors 51. Accordingly, when the top blade is moved downward, the other blades may also move downward. In the present embodiment, connectors 51 only connect the top three blades, with the fourth blade fixed in place. However, in other embodiments all blades may be connected and movable. A knob 53 is connected to the cam-shaped shaft 52 and is rotatable as shown by arrows. Upon rotation of knob 53, the shaft 52 will also rotate. In certain embodiment, a marking or gradation may indicate, visually, tactilely, or otherwise, that the blades 12 have been advanced appropriately for a sharpening cycle. For example, notches in a connection between the knob and/or shaft to the cartridge may indicate a certain distance of advancement. As such, one or a predetermined number of "clicks" may be required to advance the blades per sharpening cycle.

In one embodiment of use, a user may use a cartridge razor for shaving as usual. Once the blades become dull, the sharpener of the present invention may be used to sharpen the razors in the cartridge base. In one embodiment, a sharpener that slides over the razor blades may be used. This may be permanently attached to the cartridge base, or may be removably attachable. To sharpen the blades, the user may draw the sharpener back and forth (as indicated on the arrows of FIG. 1, for example). After a certain number of back and forth motions, the blades will again be sharp and cleared of debris. The user may then resume use of the cartridge razor as usual with newly sharpened blades.

While several variations of the present invention have been illustrated by way of example in preferred or particular embodiments, it is apparent that further embodiments could be developed within the spirit and scope of the present invention, or the inventive concept thereof. However, it is to be expressly understood that such modifications and adaptations are within the spirit and scope of the present invention, and are inclusive, but not limited to the following appended claims as set forth.

What is claimed is:

1. A razor blade sharpening device for sharpening blades of a cartridge razor comprising:

a unitary body configured and sized to be connected to a front portion of the cartridge razor;

a plurality of sharpening faces formed by the unitary body, each of the plurality of sharpening faces configured to interface with one of a plurality of blades attached to a cartridge base of the cartridge razor and configured to sharpen both a top and a bottom face of each of the plurality of blades simultaneously as the sharpening face is passed over a blade edge;

wherein the body is slideable over a length of a front of the cartridge razor when connected to the cartridge razor such that the plurality of sharpening faces passes over the plurality of blade edges wherein the front is a part of the cartridge razor which contacts a user's skin when in use; and wherein the plurality of blades are positioned facing the front of the cartridge razor, the razor blade sharpening device configured to sharpen the plurality of blades while the plurality of blades remain in position.

2. The razor blade sharpening device of claim 1 wherein the sharpening device is removably attachable to the cartridge razor.

3. The razor blade sharpening device of claim 1 wherein each of the plurality of sharpening faces comprises a hard sharpening material different from a material of the body.

4. The razor blade sharpening device of claim 1 wherein each of the plurality of sharpening faces is configured to hone the blade edge by aligning the blade edge when the sharpening face passes over the blade edge.

5. The razor blade sharpening device of claim 1 wherein each of the plurality of sharpening faces is configured to create a new blade face of the blade edge by removing blade material to create a new blade edge when the sharpening face passes over the blade edge.

6. The razor blade sharpening device of claim 1 wherein the body and the plurality of sharpening faces are formed of the same material.

7. The razor blade sharpening device of claim 1 wherein the sharpening device is removably attachable to the cartridge razor, the sharpening device comprising a connector extending from the body, the connector configured to engage with a portion of the cartridge, the connector allowing the body to be slideable along the length of the cartridge.

8. A sharpenable razor blade cartridge comprising:

a cartridge base, the cartridge base comprising a plurality of razor blades connected to the cartridge base and a connection portion allowing connection to a razor handle;

a sharpening device attached to the base, the sharpening device configured to sharpen the plurality of blades, the sharpening device comprising:

a unitary body positioned over a front portion of the cartridge razor adjacent to the plurality of blades;

a plurality of sharpening faces formed by the unitary body, each one of the plurality of sharpening faces interfaced with one of the plurality of razor blades ef connected to the cartridge base and configured to sharpen both a top and a bottom face of each of the plurality of blades simultaneously as the sharpening face is passed over a blade edge;

the sharpening device comprising a connector extending from the body, the connector engaged with a portion of a cartridge body, allowing a sliding motion of the sharpening device along a length of the base;

wherein the sharpening device is slideable over the length of the front portion of the cartridge base by the connector such that the plurality of sharpening faces pass over the plurality of blades at a blade edge; wherein the front portion is a part of the cartridge razor which contacts a user's skin when in use; and wherein the plurality of blades are positioned facing the front of the cartridge razor, the razor blade sharpening device configured to sharpen the plurality of blades while the plurality of blades remain in position.

9. The sharpenable razor blade cartridge of claim 8 wherein the sharpening device is removably attachable to the cartridge razor.

10. The sharpenable razor blade cartridge of claim 8 wherein the sharpening face comprises a hard sharpening material different from a material of the body.

11. The sharpenable razor blade cartridge of claim 8 wherein the body and the sharpening face are formed of the same material.

12. The sharpenable razor blade cartridge of claim 8 further comprising a blade position adjuster configured to adjust a position of the blades after sharpening.

13. The sharpenable razor blade cartridge of claim 12 wherein the blade position adjuster is a cam-shaped shaft in contact with at least one of the plurality of blades, a position of the at least one of the plurality of blades caused by a rotation of the cam-shaped shaft.

14. The sharpenable razor blade cartridge of claim 8 further comprising a razor handle, the razor handle connected to the cartridge at the connection portion.

* * * * *